United States Patent [19]

Holmström

[11] Patent Number: 4,779,921

[45] Date of Patent: Oct. 25, 1988

[54] ADJUSTABLE CHAIR

[76] Inventor: Erik F. Holmström, Vasaesplanaden 2 D 84, 65120 Vasa, Finland

[21] Appl. No.: 91,207

[22] Filed: Aug. 31, 1987

[51] Int. Cl.[4] ..... A47C 1/02

[52] U.S. Cl. ..... 297/88; 297/328

[58] Field of Search ..... 297/68, 86, 87, 88, 297/328, 329, 269

[56] References Cited

U.S. PATENT DOCUMENTS

| | | | |
|---|---|---|---|
| 629,036 | 7/1899 | Koenigkramer . | |
| 941,919 | 11/1909 | Greilick | 297/328 X |
| 1,048,306 | 12/1912 | Greilick | 297/329 |
| 2,617,471 | 11/1952 | Lorenz | 297/87 |
| 2,659,415 | 11/1953 | Hughes | 297/88 |
| 2,672,918 | 3/1954 | Luckhardt | 297/86 |
| 2,755,843 | 7/1956 | Carlson | 297/88 |
| 2,767,773 | 10/1956 | Forry | 297/86 |
| 2,823,731 | 2/1958 | Miller | 297/87 |
| 2,909,213 | 10/1959 | Winick | 297/86 |
| 2,942,650 | 6/1960 | Hoffman | 297/88 X |
| 3,101,216 | 8/1963 | Schliephocke | 297/88 |

FOREIGN PATENT DOCUMENTS

| | | |
|---|---|---|
| 43460 | 4/1971 | Finland . |
| 67174 | 10/1984 | Finland . |
| 104303 | 7/1964 | Norway . |

*Primary Examiner*—Francis K. Zugel
*Attorney, Agent, or Firm*—Ladas & Parry

[57] ABSTRACT

This invention relates to an adjustable chair comprising a frame supporting a seat pivotable with respect to the frame and a back, said chair further comprising a calf support arranged at the forward end of the seat and displaceable between a retracted position in which it is positioned substantially under the seat, and an extended position in which it forms a substantially straight extension of the seat; and a chair adjusting mechanism comprising a drive means provided with a supporting surface, which drive means through a movement such that the seat slides with respect to said supporting surface brings the seat into different using positions so that when the calf support is positioned in its retracted position, the seat forms a less tilted positioned than when the foot support is positioned in its extended position. In order that persons of different size would be able to easily adjust the chair into the desired position, the chair is mainly characterized in that said chair adjusting mechanism comprises an elastic press element which is to be pressed against the supporting surface of said drive means by means of a manually operated operating device with a selectable press effect so that the movement for bringing the chair into its different using positions can be carried out selectively between an easy and stiff movement.

8 Claims, 2 Drawing Sheets

FIG. 4
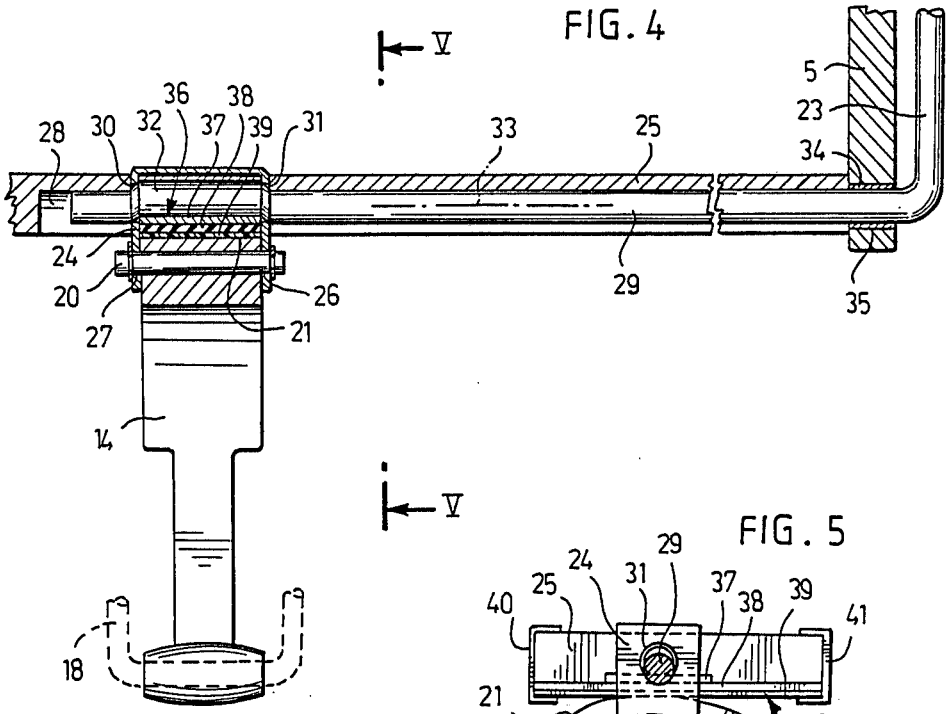
FIG. 5
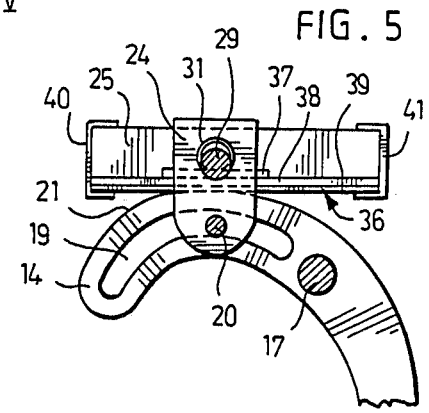
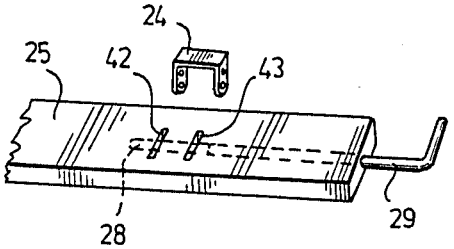
FIG. 6

ADJUSTABLE CHAIR

FIELD OF THE INVENTION

This invention relates to an adjustable chair the tilt of the seat and the back of which is adjustable and which comprises an adjustable calf support arranged at the forward end of the seat. The chair comprises an adjusting mechanism including a drive means with a supporting surface for the seat.

BACKGROUND OF THE INVENTION

A chair of this type is known from Finnish Patent Specification Nos. 67,174 and 43,460. Similar chairs are also disclosed in U.S. Patent Specification Nos. 2,617,471 and 2,767,773 and Norwegian Patent Specification No. 104,303. These prior chairs are adjustable in such a way that a person who sits in the chair is able to assume a normal sitting position and at least one other position in which the person is more or less in a lying position with the calves more or less raised and directed forwards. Chairs according to the prior art do not enable a normal sitting position to be altered continuously and easily into a partly lying or a lying position with a possibility of locking all positions between these positions and in such a way that when being adjusted, the chair possesses an adjustable resistance to motion so that persons of different size and weight can easily change the movement characteristic of the chair as desired, which is important in order that the chair would function in a way expected from chairs of this type.

SUMMARY OF THE INVENTION

The present invention relates to a new adjustable chair with improved operating qualities and without the disadvantages of prior chairs. For the achievement thereof, the chair according to the invention is mainly characterized in that the chair adjusting mechanism comprises an elastic press element which can be pressed against a supporting surface of the driving means by means of a manually operated operating device with a selectable press effect so that the movement for passing the chair into its different using positions can be carried out selectively between an easy and slow movement. The manually operated operating device of the chair adjusting mechanism is preferably formed by a rod which is mounted in the seat and which comprises an eccentric part, and the press element is formed by a planar part which is positioned between the supporting surface of the drive means and the eccentric part of the rod, whereby the position of the planar part with respect to the supporting surface of the drive means is adjustable by means of the rotation of the rod, which enables the planar part to be positioned against the supporting surface of the drive means with a selectable press effect. Further, the planar part is preferably formed by a lamellar structure comprising a plate of high bending resistance, e.g. manufactured of metal, a rubber layer and a PTFE layer, which are so joined with each other that the plate faces the eccentric part of the rod and the PTFE layer faces the supporting layer of the drive means, whereby the PTFE layer forms a slide surface for the supporting surface of the drive means.

The chair according to the invention is advantageous mainly in that it is easily adjustable manually to a desired position by persons of different size, i.e. weight and height, and at the same time it offers many-sided adjusting possibilities. Thereby a small and light person, e.g., can change the chair from one position to another, as desired, with less force than a tall, heavy person. In addition, the structure of the chair is simple, on account of which the chair is advantageous to manufacture.

BRIEF DESCRIPTION OF THE DRAWINGS

The invention will be described in the following by means of a preferred embodiment with reference to the attached drawings, wherein FIG. 4 is an enlarged detailed view of the adjusting mechanism of the chair as seen along the intersectional line IV—IV shown in FIG. 3, FIG. 5 shows the adjusting mechanism of the chair as seen along the intersectional line V—V shown in FIG. 4, and FIG. 6 is a reduced view of a part of the adjusting mechanism of the chair.

DETAILED DESCRIPTION

Figure 1:
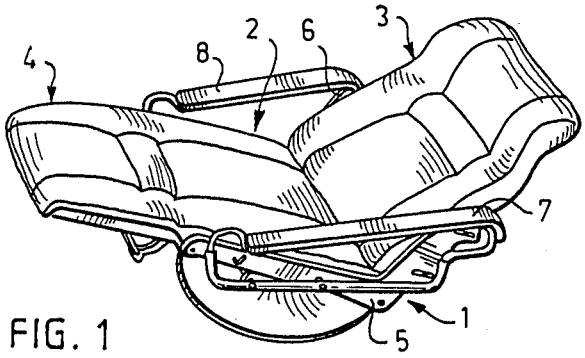
FIG. 1 is a side view of the chair as seen obliquely from the above when in the lying position.

FIG. 1 shows a general view of a chair comprising a frame which is indicated generally with the reference numeral 1 and which supports a seat indicated generally with the reference numeral 2 and a back indicated generally with the reference numeral 3 and a support for feet and calves which is pivotable on a hinge attached to the forward end of the seat and indicated with the reference numeral 4. In FIG. 1, the chair is in the lying position, which means that the back 3 is relatively strongly tilted backwards and the calf support 4 forms a straight extension of the seat 2. Arm rests 7, 8 for the chair are fastened to the side portions 5, 6 of the seat.

Figure 2:
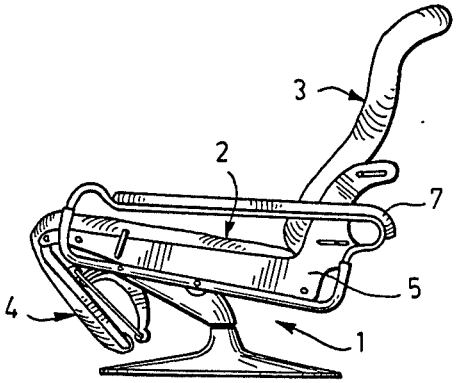
FIG. 2 is a side view of the chair when in the sitting position.

FIG. 2 shows the chair from the side in a sitting position, whereby the back 3 is in a more upright position than in FIG. 1 and the calf support 4 is positioned in its retracted position under the seat 2.

Figure 3:
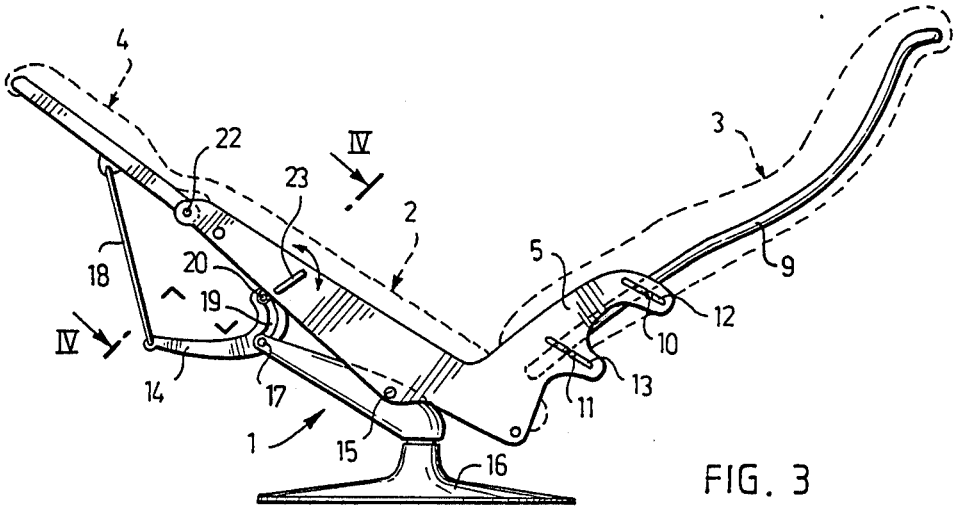
FIG. 3 is a side view of the chair when in the lying position.

FIG. 3 shows the chair from the side in the lying position. In the figure, the contours of the covering of the back of the chair are indicated with a dashed line in order to more clearly illustrate the structure of the back 3. It appears from the figure that the back 3 comprises a surrounding pipe 9 which forms the frame of the back and to which the covering of the back is fastened. Said pipe 9 is fastened on both sides of the chair to its side portions 5 by means of two pins 10, 11 extending into slits 12, 13, respectively, arranged in the side portions, which pins can be locked in the slits in a conventional manner, e.g. by means of screws to be tightened manually. The pins 10, 11 and the slits 12, 13 together enable the back 3 to be displaced so that the length of the seat 2 becomes adjustable.

FIG. 3 also shows the chair adjusting mechanism comprising a drive means 14, which mechanism enables the chair to be adjusted from a resting position to a sitting position. The seat 2 is through the side portions 5, 6 mounted on a supporting shaft 15 which is supported by a stand 16 of the frame. The drive means 14 is formed by a tilting lever which is mounted on a horizontal shaft 17 in the stand 16. In one end of the tilting lever 14 is mounted a supporting element in the form of a rod 18 which is mounted pivotably in the foot portion 4. The other end of the tilting lever 14 is provided with an elongated curved opening 19 with a constant width, and a roll or a shaft 20 having substantially the same diameter as the width of the opening is arranged in said opening so that the roll can rotate in the opening along its inner surfaces. The roll 20 is mounted in a holder which will be described below in connection with FIG. 4. In the tilting lever 14 a surface 21 facing the lower part of the seat 2 simultaneously acts as a support and slide surface along which the seat slides when the tilting lever is pivoted on the shaft 17. The shape of the tilting lever 14 as well as its interaction with the curved opening 19 provide the chair with such a movement characteristic that when the calf support 4 is in the retracted position, the seat 3 is in a less tilted position than when the calf support is positioned in its extended position. The calf support 4 is fastened to the forward end of the seat 2 in a bearing indicated with the reference numeral 22. The resistance of the movement of the tilting lever 14 can be adjusted by displacing a bar 23 projecting from the side portion 5 in the direction of the arrow.

FIG. 4 is a more detailed view of the chair adjusting mechanism. It appears from the figure that the tilting lever 14 is positioned symmetrically in the chair, which enables the seat to be supported in a simple way and without a disadvantageous torsional moment. The tilting lever 14 is connected to a transverse support 25 positioned in the seat by means of a U-shaped holder 24, and the transverse support joins the side portions of the seat, of which side portions only the side portion 5 is visible in the figure. Both legs of the U-shaped holder 23 are provided with two holes 26 and 27 for the shaft 20 which transmits the movement of the tilting lever 14 to the seat 2. Roller bearings (not shown) may be arranged in the holes 26 and 27 so that the shaft 20 can easily roll along the inner surfaces of the opening 19. The transverse support 25 is provided with an elongated groove 28 in which the manually operated operating device of the chair adjusting mechanism, formed by a rod in the form of a crankshaft 29, is fitted. The crankshaft 29 extends through the U-shaped holder 24 through two holes 30 and 31 in such a manner that an eccentric part 32 of the crankshaft is positioned above the tilting lever 14. The groove 28 is deepened adjacent to the eccentric part 32 of the crankshaft so that the crankshaft is able to rotate 360° in the groove without that the central axis 33 of the crankshaft has to change place during the rotation. The transverse support 25, made of e.g. plywood, provides efficient supportion for the crankshaft 29, because this is supported by the groove 28 substantially over the whole length thereof. That end of the crankshaft 29 which projects towards the side support 5 of the chair is mounted in a sleeve 34 divided in two parts. The sleeve 34 is divided in such a manner that it is formed by two semicircular parts which are easy to mount after the crankshaft 29 has been passed through the hole 35 provided in the side portion 5 in connection with the assembly of the chair. Alternatively, it is possible to use an oval sleeve.

Between the eccentric part 30 of the crankshaft 29 and the supporting surface 21 of the tilting lever there is provided an elastic press element formed by a lamellar structure which is indicated generally with the reference numeral 36. This lamellar structure comprises at the top thereof a plate 37 of high bending resistance, under which a rubber layer 38 is provided, and at the very bottom there is a PTFE layer (i.e. a TEFLON layer). The plate 37 having a high bending resistance is preferably manufactured of steel and its thickness preferably ranges from 1 to 3 mm. The plate 37, possibly yielding slightly under strain, is guided in the vertical direction by means of the horizonal sides of the groove 28. The thickness of the rubber layer 38 preferably ranges from 2 to 4 mm, and the polytetrafluoroethylene (PTFE) layer 39 is 0.3 to 1 mm in thickness. The rubber layer 38 is of great importance in that it enables the PTFE layer 39 of the lamellar structure 36, which faces an upper surface 21 of the tilting lever 14, to take the same bent shape as said surface 21. It also appears from the above that the PTFE layer 39 must not be too thick, because it has to yield in use.

The mechanism shown in FIG. 4 functions in such a way that when the bar 23 is turned downwards, the eccentric part 32 of the crankshaft 29 is also turned downwards, whereby the eccentric part is pressed against the plate 37 of the lamellar structure 36 so that the plate 37 transmits the press effect through the yieldable rubber layer 34 to the contact surface between the PTFE layer 39 and the upper surface 21 of the tilting lever 14. Depending on the position of the bar 23 the eccentric part 32 is made to be pressed against the lamellar structure with a varying press effect so that the movement of the chair can be varied between stiff and easy. When the eccentric part 32 is in its lowermost position.

FIG. 5 shows the chair adjusting mechanism in a side view along the intersectional line V—V shown in FIG. 4. It appears from the figure that the lamellar structure 36 is maintained in a compressed state by means of two U-shaped clamps 40 and 41 which clamp both the lamellar structure and the transverse support 25. So assembled, the lamellar structure 36 may be joined to the seat of the chair simultaneously as its layers are joined together, i.e. the layers 37 to 39 need not be glued or riveted together separately.

FIG. 6 shows how the U-shaped holder 24 and the crankshaft 29 are mounted on the transverse support 25 of the chair. The arrow adjacent to the holder 24 shows that at the assembly the holder is passed through two slits 42 and 43 which go through the transverse support 25. Thereafter the crankshaft 29 is pushed from the side through the side portion of the chair (not shown in FIG. 6) into the groove 28 of the transverse support 25, shown by a broken line, and further through the holes 30 and 31 within the legs of the holder 24.

The invention has been described above solely by means of a preferred embodiment. It is to be understood that the present invention can be carried out in various ways within the scope of the attached claims. Thereby it is possible to use, instead of a separate tilting means positioned between the crankshaft and the supporting surface of the tilting lever, a press element which is fastened either to the drive means (the tilting lever) or to the manually operated operating device (the crankshaft). So the press element can be glued on the supporting surface of the tilting lever. Essential is that the press element is elastic. The press element need not, of course, be a lamellar structure with a PTFE layer as a press and slide surface. In place of a PTFE layer it is possible to use a layer of some other material having similar slide and strength properties, e.g. a polyamide layer (PA). However, a PA layer does not have such excellent slide and support properties than a PTFE layer. Further, the PTFE layer makes the adjusting movement of the chair soundless and the PTFE layer need not, either, be provided with a sliding agent as it is a low-friction material. It is also possible to omit the PTFE layer from the lamellar structure, whereby the rubber layer forms the press and slide surface. The rubber layer can be replaced with some other material of similar elastic properties. Furthermore, in claim 1, the expression "manually operated operating device" is not to be understood only as a purely mechanical device, but it can include some kind of hydraulic system.

What is claimed is:

1. An adjustable chair comprising:

a frame;

a seat supported by and pivotably connected to said frame;

a back;

a calf support arranged at a forward end of the seat;

a chair adjusting mechanism enabling displacement of the chair between a retracted position in which the calf support is situated substantially under the seat, and an extended position in which the calf support forms a substantially straight extension of the seat and the seat and the back are positioned in a more inclined position than in said retracted position, said chair adjusting mechanism comprising a drive means which is pivotably connected by means of a shaft to said frame and is provided with a seat supporting surface which is slidable with respect to the seat, said chair adjusting mechanism further comprising an elastic press element which is positioned between said supporting surface of said drive means and a manually operated operating device comprising pressing means for exerting a selected pressure on the press element.

2. An adjustable chair according to claim 1, wherein the manually operated operating device of the chair adjusting mechanism is formed by a rotatable rod which is mounted in the seat and comprises an eccentric part forming said pressing means, and wherein said elastic press element of the chair adjusting mechanism is formed by a planar lamellar structure comprising a plate of high bending resistance, a rubber layer and a plastics layer which are joined together so that the plate faces the eccentric part of said rod and the plastics layer faces the supporting surface of said drive means, the plastics layer forming a slide surface against the supporting surface of said drive means.

3. An adjustable chair according to claim 2, wherein said rod, said lamellar structure and said drive means are clamped together by means of a U-shaped holder fastened in two through-going slits formed in a transverse support in the seat, said support binding together side portions in the seat.

4. An adjustabale chair according to claim 3, wherein said transverse support comprises an elongated groove for receiving said rod, said groove being deepened adjacent to the eccentric part of said rod to enable the rotation of the rod.

5. An adjustable chair according to claim 4, wherein said lamellar structure is maintained in the compressed state by means of U-shaped clamps which clamp together both the lamellar structure and the transverse support.

6. An adjustable chair according to claim 5, wherein said plate with high bending resistance is 1 to 3 mm in thickness and is made of metal, said rubber layer is 2 to 4 mm in thickness and said PTFE layer is 0.3 to 1 mm in thickness.

7. An adjustable chair according to claim 1, wherein said rod is a crankshaft one end of which is provided with a bar projecting from one side portion of the seat, in which side portion said crankshaft is mounted in a sleeve comprising two semicircular parts so as to enable the crankshaft to be passed through the side portion at the assembly of the chair, said bar being bent at substantially right angles with respect to the crankshaft so that it can be easily gripped by a person who sits in the chair.

8. An adjustable chair according to claim 2, wherein the plastics is polytetrafluoroethylene (PTFE).

* * * * *